US009307875B2

(12) United States Patent
Clarkin

(10) Patent No.: US 9,307,875 B2
(45) Date of Patent: Apr. 12, 2016

(54) CONCEALABLE TOILET PAPER SPINDLE AND METHOD OF USE

(71) Applicant: Chad Clarkin, San Diego, CA (US)

(72) Inventor: Chad Clarkin, San Diego, CA (US)

( * ) Notice: Subject to any disclaimer, the term of this patent is extended or adjusted under 35 U.S.C. 154(b) by 254 days.

(21) Appl. No.: 14/067,058

(22) Filed: Oct. 30, 2013

(65) Prior Publication Data

US 2014/0131506 A1 May 15, 2014

Related U.S. Application Data

(60) Provisional application No. 61/825,353, filed on May 20, 2013, provisional application No. 61/725,568, filed on Nov. 13, 2012.

(51) Int. Cl.

| | |
|---|---|
| ***B65H 75/18*** | (2006.01) |
| ***A47K 10/38*** | (2006.01) |
| ***A47K 1/09*** | (2006.01) |
| ***A47K 3/28*** | (2006.01) |
| ***A47K 17/00*** | (2006.01) |
| *A47K 10/32* | (2006.01) |
| *E04F 19/08* | (2006.01) |

(52) U.S. Cl.

CPC . *A47K 10/38* (2013.01); *A47K 1/09* (2013.01); *A47K 3/281* (2013.01); *A47K 10/3836* (2013.01); *A47K 17/00* (2013.01); *A47K 2010/3233* (2013.01); *E04F 19/08* (2013.01)

(58) Field of Classification Search

CPC ..... A47K 1/09; A47K 3/281; A47K 10/38; A47K 10/3836; A47K 17/00; A47K 2010/3233

USPC ..... 242/597, 597.7, 597.8, 598.5, 598.6

See application file for complete search history.

(56) References Cited

U.S. PATENT DOCUMENTS

| | | | | |
|---|---|---|---|---|
| 617,292 | A * | 1/1899 | Kleiner | A47F 3/10 312/125 |
| 1,952,686 | A | 3/1934 | Sakier | |
| 2,039,065 | A * | 4/1936 | De Mark | A47K 1/09 311/119.009 |
| 2,576,526 | A | 11/1951 | Marchand | |
| 3,062,606 | A | 11/1962 | Magrauth | |

(Continued)

FOREIGN PATENT DOCUMENTS

JP 3037240 U9 2/1997

OTHER PUBLICATIONS

International Search Report and Written Opinion for corresponding application No. PCT/US2013/068722, mailed on Feb. 14, 2014, in 14 pages.

(Continued)

*Primary Examiner* — William A Rivera

(74) *Attorney, Agent, or Firm* — Procopio Cory Hargreaves & Savitch LLP

(57) ABSTRACT

A concealable waste paper holder for dispensing waste paper from a waste paper roll includes a frame mountable to a wall; a door rotatably mounted to the frame about a door rotational axis between an open position where the waste paper roll is accessible and a closed position where the door is substantially parallel with the wall and conceals the waste paper roll; a spindle for rotationally receiving the waste paper roll about a spindle axis and dispensing the waste paper from the waste paper roll there when the door is is the open position, the spindle carried by the door for rotation with the door, and wherein the spindle axis and the door rotational axis are parallel.

14 Claims, 14 Drawing Sheets

(56) References Cited

U.S. PATENT DOCUMENTS

| | | | | |
|---|---|---|---|---|
| 3,171,135 | A * | 3/1965 | Polichio | A47K 17/00 242/598.5 |
| 3,239,295 | A | 3/1966 | Simon | |
| 3,623,676 | A | 11/1971 | Eckels | |
| 3,729,145 | A | 4/1973 | Koo et al. | |
| 4,033,650 | A | 7/1977 | Alissandratos | |
| 4,219,248 | A | 8/1980 | Goldberg | |
| 4,444,359 | A | 4/1984 | Butler | |
| 4,614,312 | A | 9/1986 | Del Pino | |
| 4,721,264 | A | 1/1988 | Muscarello | |
| 5,893,531 | A | 4/1999 | Taylor et al. | |
| 7,104,620 | B2 * | 9/2006 | Atkinson | A47B 81/00 312/204 |
| 7,360,849 | B2 * | 4/2008 | Atkinson | A47K 5/04 312/242 |
| 8,128,184 | B2 * | 3/2012 | Allard | F25D 23/04 312/295 |
| 2005/0035695 | A1 | 2/2005 | Atkinson | |
| 2005/0051663 | A1 | 3/2005 | Walters | |
| 2014/0131506 | A1 * | 5/2014 | Clarkin | A47K 1/09 242/598.6 |

OTHER PUBLICATIONS

Kueber, P., "Built in bathroom scale that folds down—among the three most collectible vintage Hall-Mack & Nutone bathroom accessories", retro renovation, http://retrorenovation.com/2012/06/21/built-in-bathroom-scale-that-folds-down-among-the-three-most-collectible-vintage-hall-mack-nutone-bathroom-accessories/, (Jun. 21, 2012), accessed on Feb. 25, 2014, p. 4, 18 pages.

Pte, Plumbing Trade Essentials, "Contour 2 Tier Revolving Corner Shower Caddy, White", http://www.plumbingessentials.co.uk/contour-2-tier-revolving-257-1451513, accessed on Feb. 25, 2014, 2 pages.

Taymor, "Taymor Sunglow Collection Recessed Paper Holder with Hood", http://www.kitchensource.com/bau/tm-ba2188.htm, accessed on Feb. 21, 2014, 2 pages.

Vintage Plumbing Bathroom Antiques, "1950s Hall—Mack Bathroom Accessories", Hidden Lavatory Unit and Toilet Paper Holder, http://www.vintageplumbing.com/hallmack.html, accessed on Feb. 21, 2014, pp. 3-6, 6 pages.

Wholesale Plumbing, "Brushed Nickel Recessed Toilet Paper Holder—Includes Rear Mounting Bracket", http://www.amazon.com/Brushed-Nickel-Recessed-Toilet-Holder/dp/B005QUBVZM/ref=pd_sim_sbs_hg_4, accessed on Feb. 21, 2014, 5 pages.

* cited by examiner

CONCEALABLE TOILET PAPER SPINDLE AND METHOD OF USE

CROSS-REFERENCE TO RELATED APPLICATION

The present application claims priority to U.S. provisional patent application 61/825,353 filed May 20, 2013 and U.S. provisional patent application 61/725,568 filed Nov. 13, 2012 under 35 U.S.C. 119. Both of these applications are incorporated by reference herein.

FIELD OF THE INVENTION

This invention relates generally to toilet paper holders for the bathroom and particularly to toilet paper holders that conceal the toilet paper when not in use.

SUMMARY OF THE INVENTION

An aspect of the invention involves a concealable waste paper holder for dispensing waste paper from a waste paper roll. The concealable waste paper holder includes a frame mountable to a wall; a door rotatably mounted to the frame about a door rotational axis between an open position where the waste paper roll is accessible and a closed position where the door is substantially parallel with the wall and conceals the waste paper roll; a spindle for rotationally receiving the waste paper roll about a spindle axis and dispensing the waste paper from the waste paper roll there when the door is is the open position, the spindle carried by the door for rotation with the door, and wherein the spindle axis and the door rotational axis are parallel.

One or more implementations of the aspect of the invention described immediately above include one or more of the following: the concealable waste paper holder is a concealable toilet paper holder for dispensing toilet paper from a toilet paper roll; the concealable waste paper holder is a concealable paper towel holder for dispensing paper towel from a paper towel roll; the spindle axis and the door rotational axis are vertical; the spindle axis and the door rotational axis are horizontal; the door rotates about the door rotational axis when a user pushes in on the door at a lateral location offset from the door rotational axis; the concealable waste paper holder includes a door rotation mechanism including an axle that rotates with the door, a roll pin perpendicularly disposed relative to the axle and rotating with the axle, and a roll pin engagement surface that the roll pin slidably engages, the roll pin engagement surface including a groove that the roll pin engages, forming a stop for rotation of the door in the closed position and the open position; the door rotation mechanism includes a spring that urges at least one of the the roll pin and the engagement surface together; the axle of the door rotation mechanism is vertical; and/or the axle of the door rotation mechanism is horizontal.

An aspect of the invention involves a concealable holder for selectively concealing and accessing one or more objects. The concealable holder includes a frame mountable to a wall; a door rotatably mounted to the frame about a door rotational axis between an open position where the one or more objects are accessible and a closed position where the door is substantially parallel with the wall and conceals the one or more objects; and a holder including one or more sections for holding the one or more objects, the spindle carried by the door for rotation with the door.

One or more implementations of the aspect of the invention described immediately above include one or more of the following: the concealable holder is a concealable shower caddy for selectively concealing and accessing one or more shower objects; the concealable holder is a concealable medicine cabinet for selectively concealing and accessing at least one of one or more medicine cabinet objects and one or more toiletries; the concealable holder is a concealable toilet bowl brush holder for selectively concealing and accessing a toilet bowl brush; the concealable holder is a concealable toilet bowl plunger holder for selectively concealing and accessing a toilet bowl plunger; the door rotational axis is vertical; the door rotational axis is horizontal; the door rotates about the door rotational axis when a user pushes in on the door at a lateral location offset from the door rotational axis; the concealable holder includes a door rotation mechanism including an axle that rotates with the door, a roll pin perpendicularly disposed relative to the axle and rotating with the axle, and a roll pin engagement surface that the roll pin slidably engages, the roll pin engagement surface including a groove that the roll pin engages, forming a stop for rotation of the door in the closed position and the open position; the door rotation mechanism includes a spring that urges at least one of the the roll pin and the engagement surface together; the axle of the door rotation mechanism is vertical; and/or the door rotation mechanism is horizontal.

BACKGROUND OF THE INVENTION

Toilet paper holders that conceal the toilet paper when not in use have been devised in the past. General problems with these toilet paper holders is that they either are a part of a cabinet storage system, which takes up a lot of space in the bathroom, or they protrude unnecessarily outward from the wall when not in use, decreasing the available space around the toiler and/or creating an unsightly appearance.

DETAILED DESCRIPTION OF THE PREFERRED EMBODIMENTS

Figure 1:
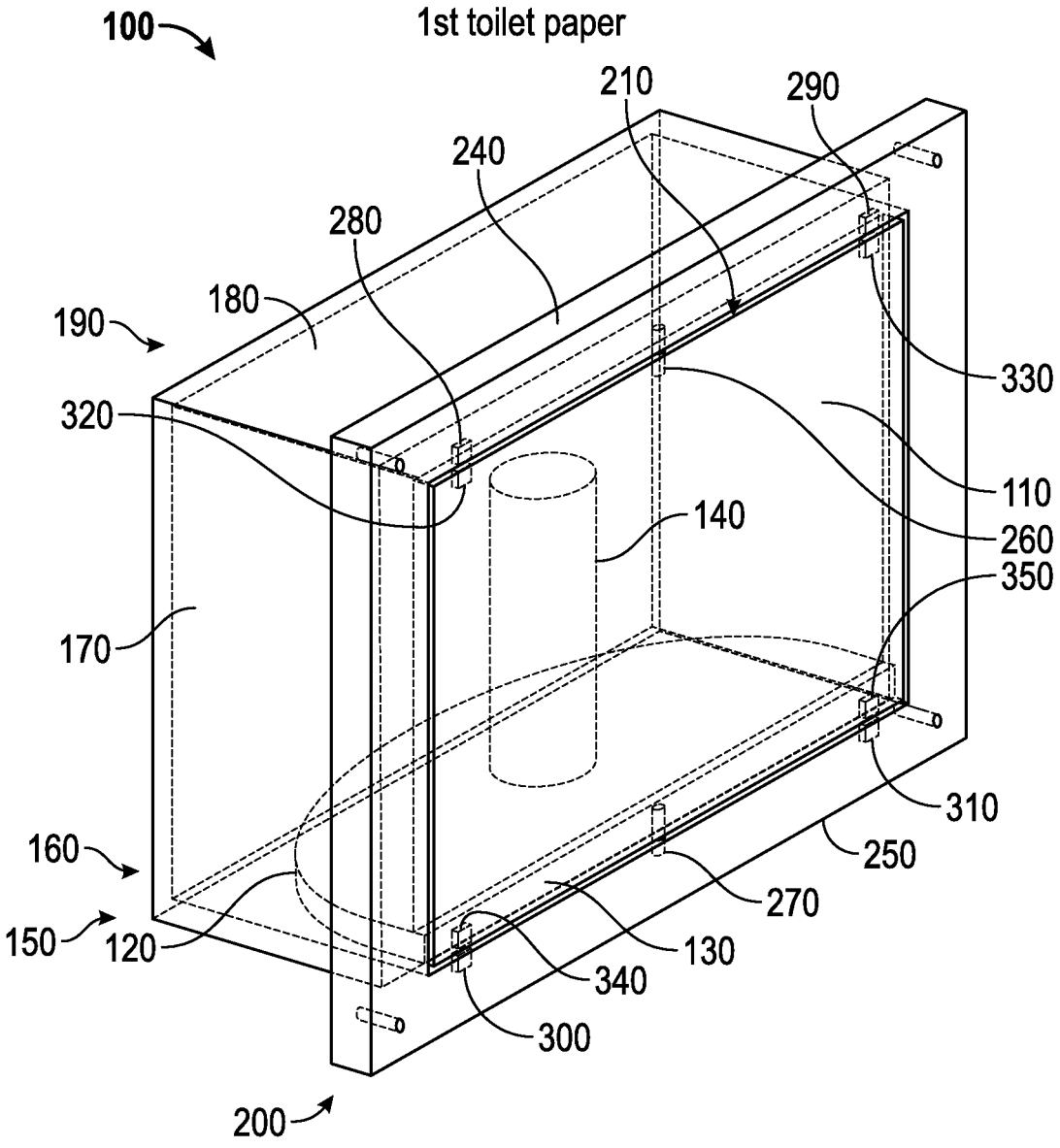
FIG. 1 is a front perspective view of an embodiment of a concealable toilet paper spindle shown in a closed condition.
Figure 2:
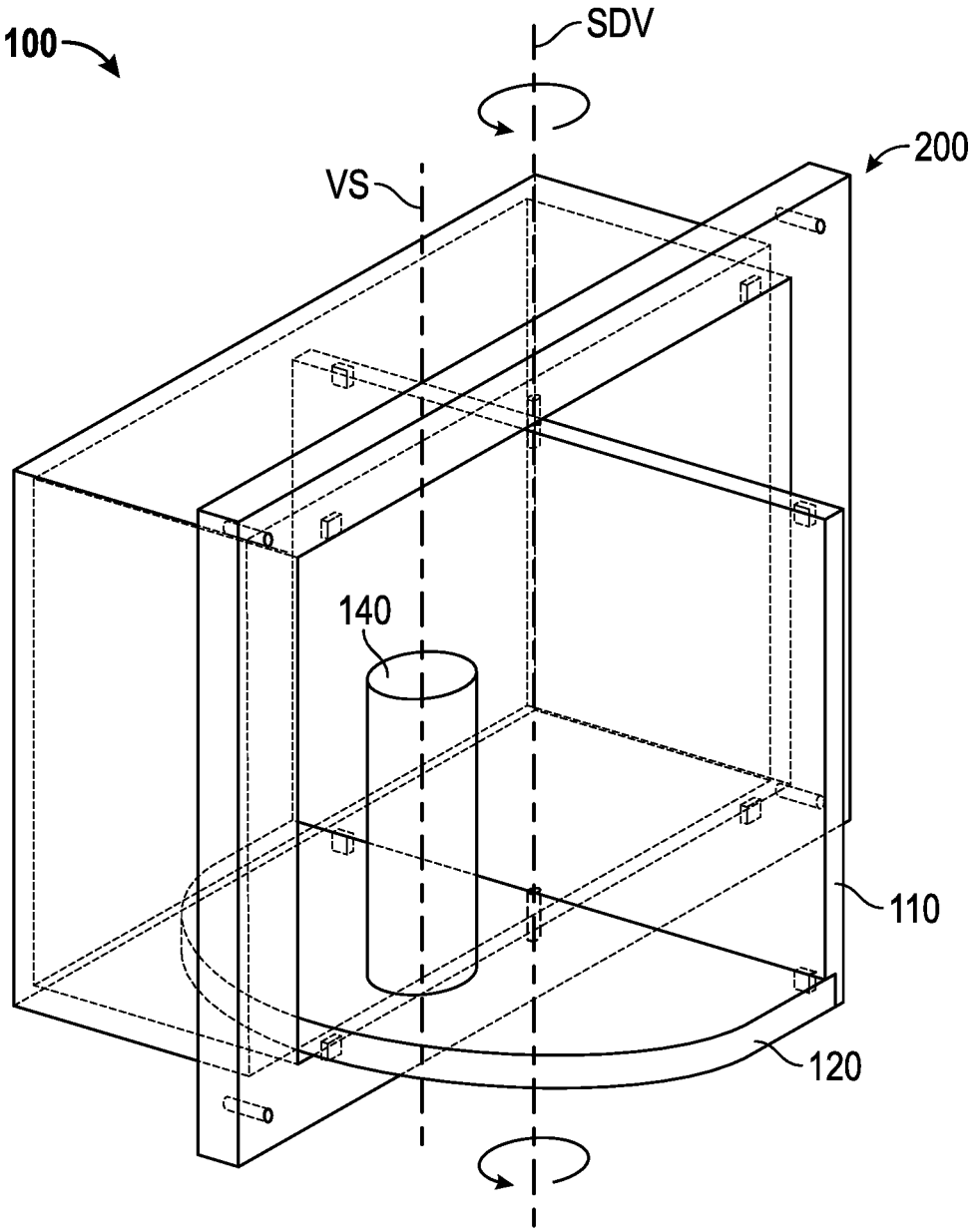
FIG. 2 is a front perspective view of the concealable toilet paper spindle of FIG. 1 shown in a partially opened condition.
Figure 3:
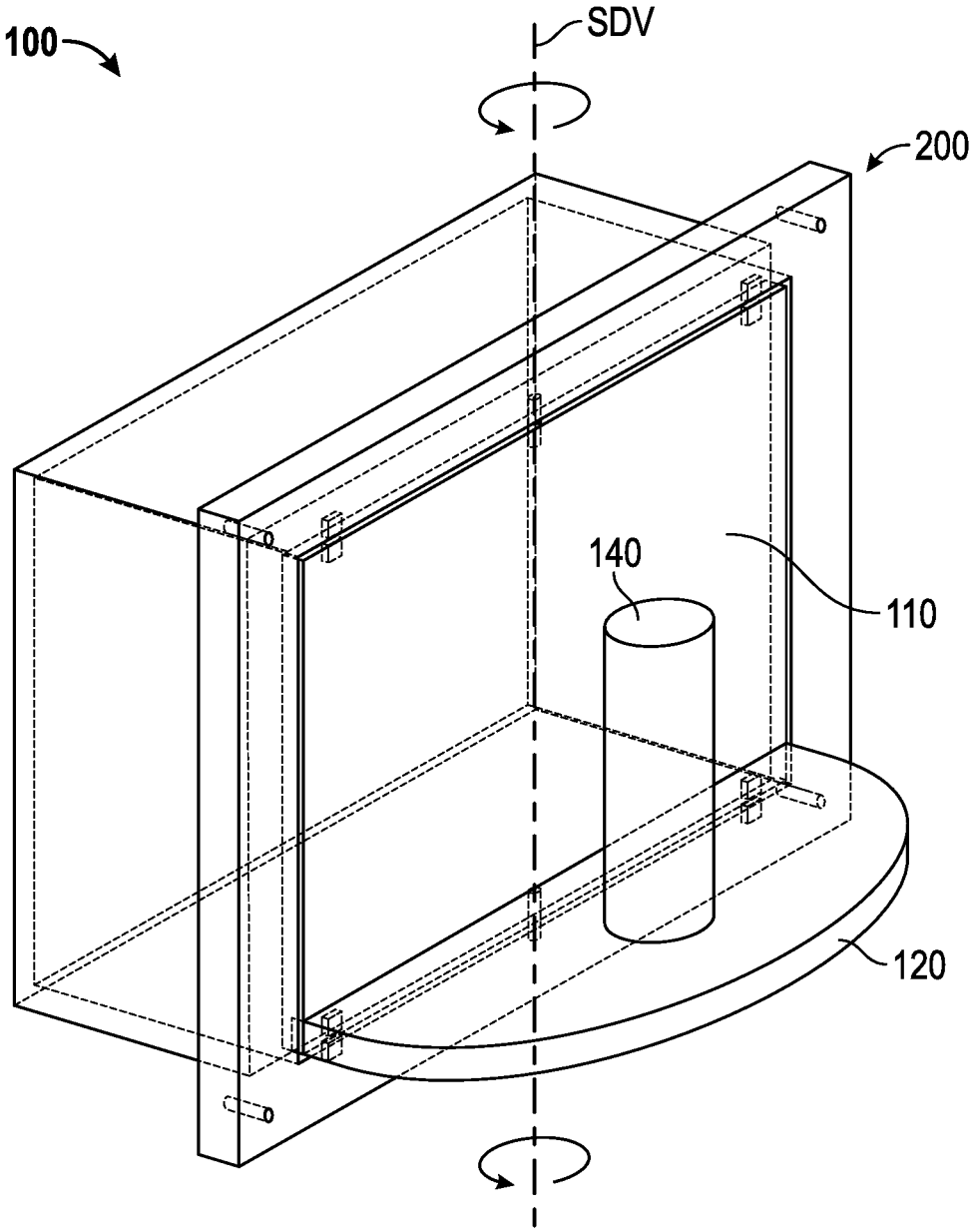
FIG. 3 is a front perspective view of the concealable toilet paper spindle of FIG. 1 shown in an open condition.
Figure 4:
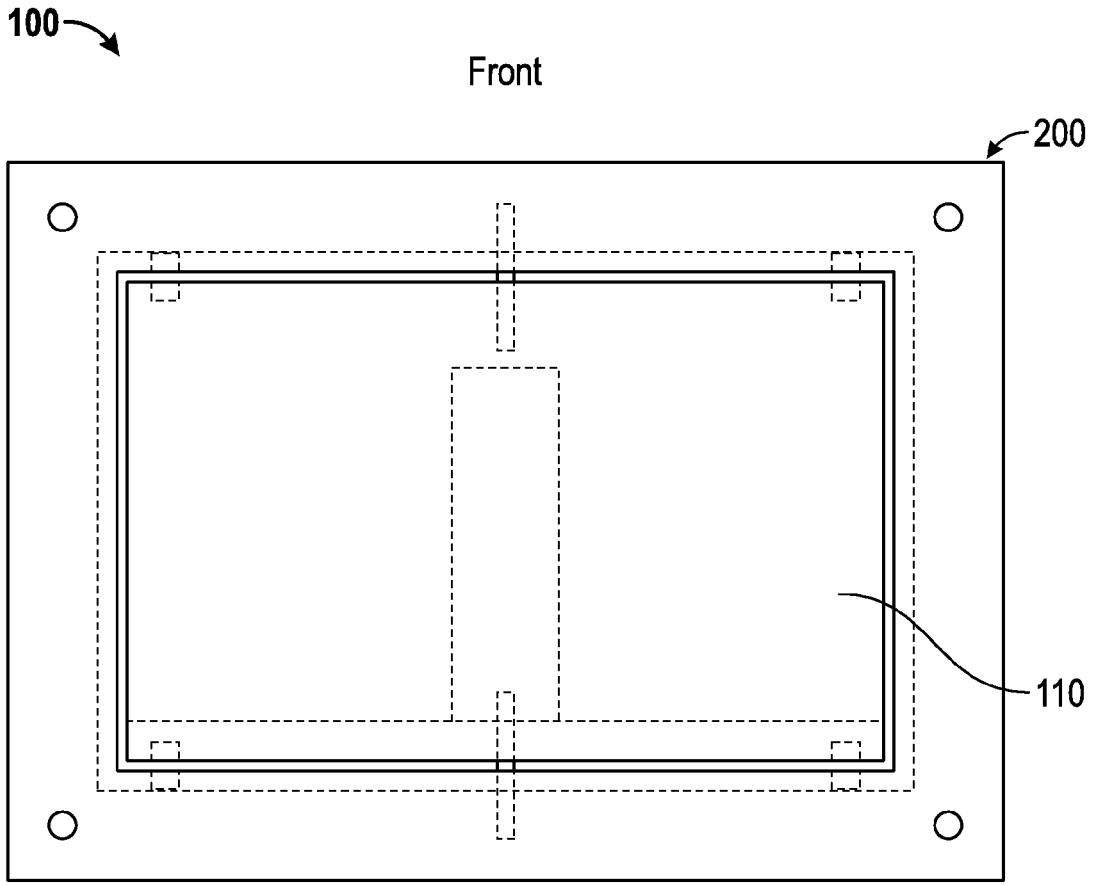
FIG. 4 is a front elevational view of the concealable toilet paper spindle of FIG. 1 shown in a closed condition.
Figure 5:
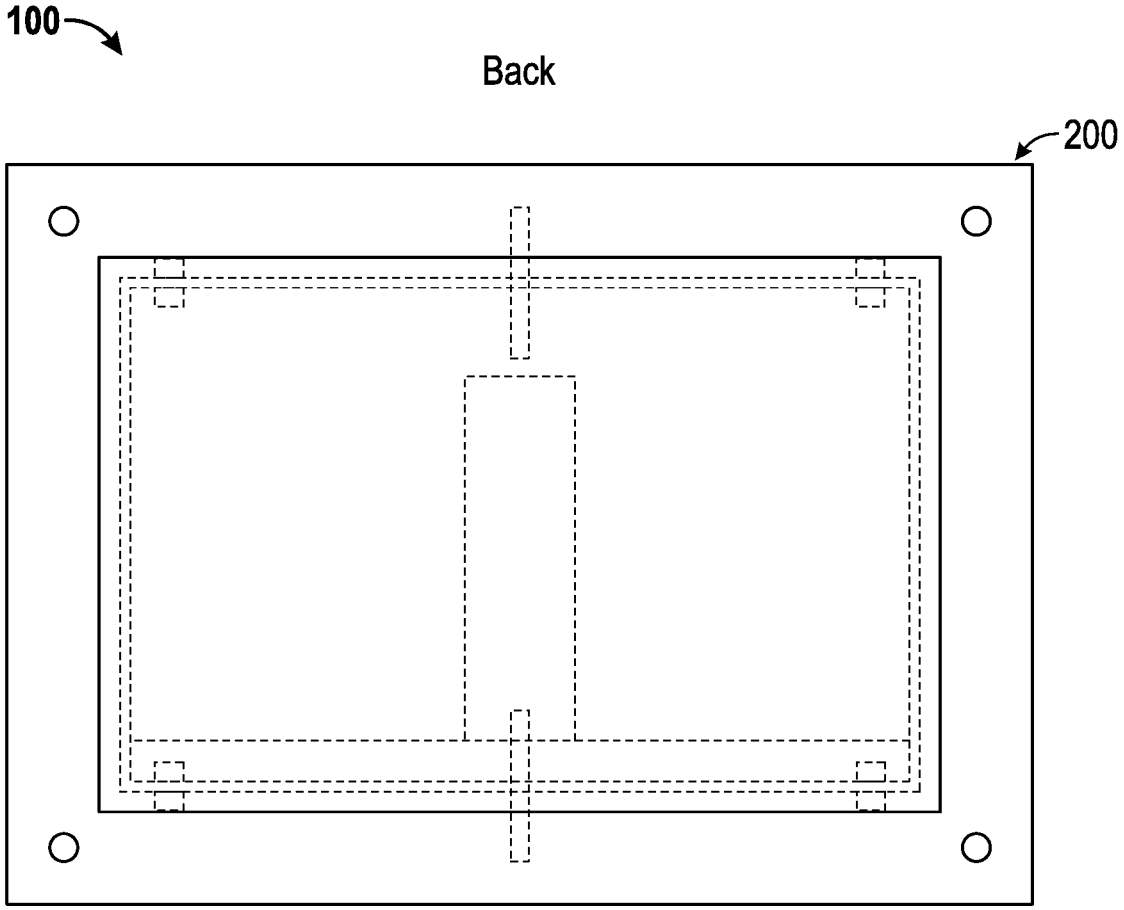
FIG. 5 is a rear elevational view of the concealable toilet paper spindle of FIG. 1 shown in a closed condition.
Figure 6:
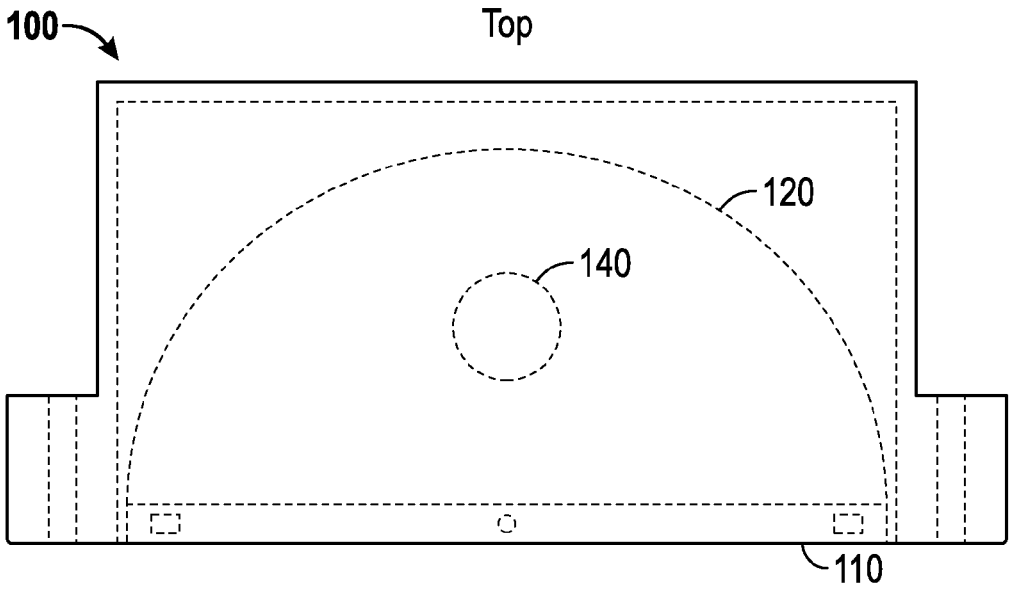
FIG. 6 is a top plan view of the concealable toilet paper spindle of FIG. 1 shown in a closed condition.
Figure 7:
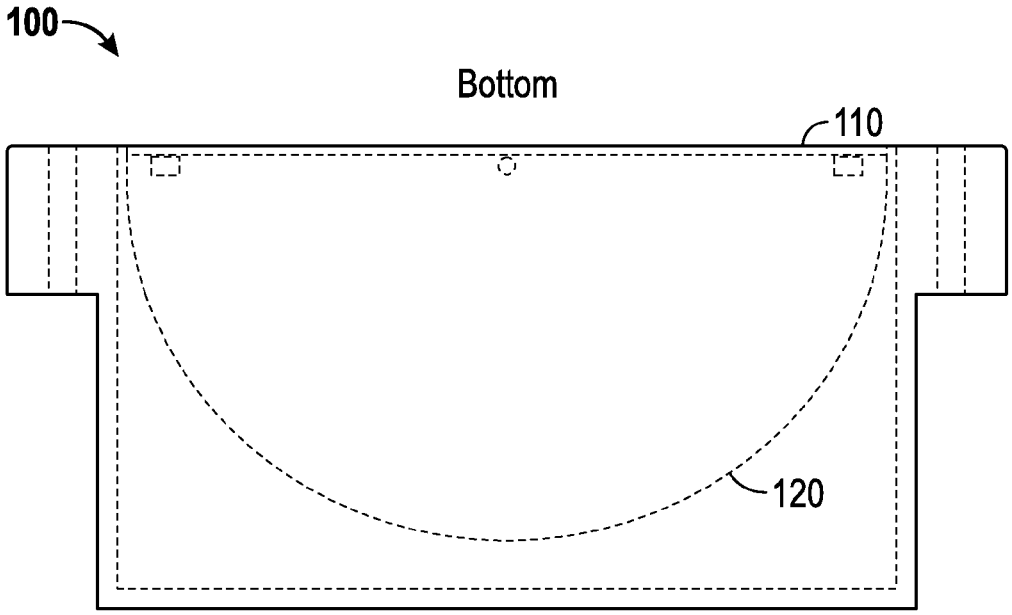
FIG. 7 is a bottom plan view of the concealable toilet paper spindle of FIG. 1 shown in a closed condition.
Figure 8:
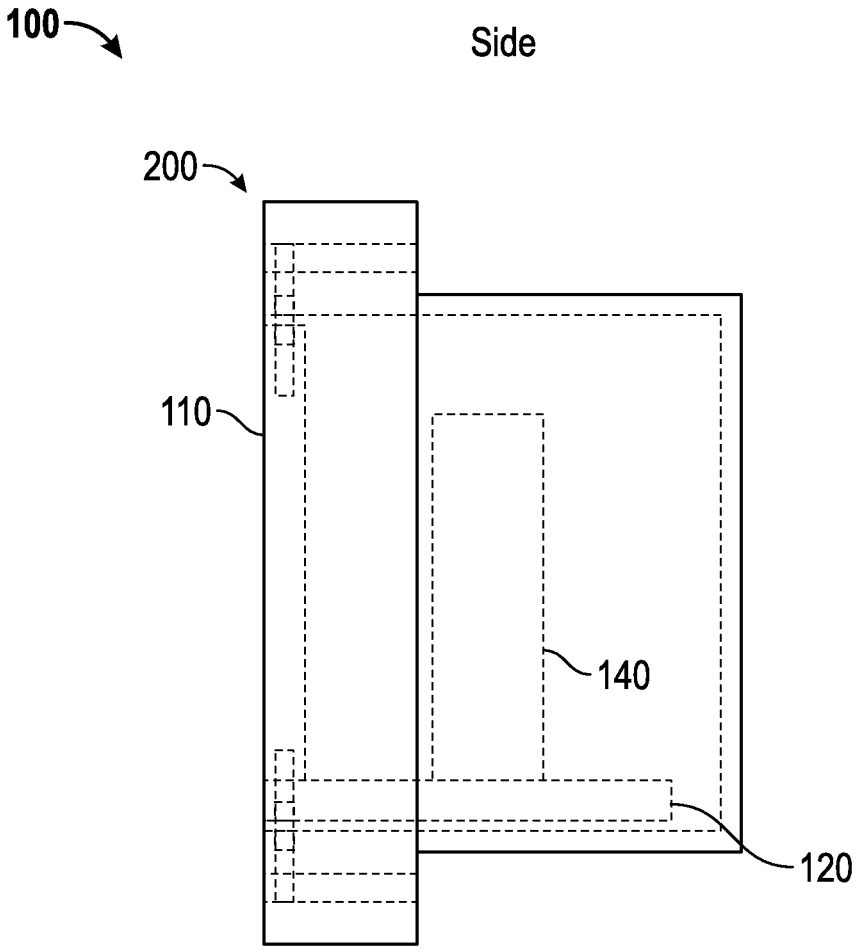
FIG. 8 is a side elevational view of the concealable toilet paper spindle of FIG. 1 shown in a closed condition.

With reference initially to FIGS. 1-8, an embodiment of a concealable toilet paper spindle 100 will be described. FIGS. 1 and 4-8 show the concealable toilet paper spindle 100 in a closed condition where toilet paper on and in the spindle 100 is concealed. FIG. 2 shows the spindle 100 in a partially open condition. FIG. 3 shows the spindle 100 in a completely open condition.

The spindle 100 includes a thin rectangular front door panel or door 110 and a half circle platform 120 extending laterally along a bottom edge 130 of the door panel 100. A vertical spindle 140 extends upwardly from a substantial center of the platform 120. The vertical spindle 140 includes a central longitudinal axis VS 80 (See FIG. 2). In the closed condition shown in FIG. 1, the door panel 100, platform 120, and vertical spindle 140 are disposed with a framed housing 150. The framed housing 150 has a substantially rectangular box shaped housing member 160 with parallel side walls 170, parallel top/bottom walls 180, and rear wall 190. A rectangular frame member 200 is attached to a front of the housing member 160. An interior of the frame member 200 includes a rectangular opening 210 that the thin rectangular front door panel 110 is disposed within. The frame member 200 includes first and second parallel side members 220, 230 and parallel top/bottom members 240, 250. At a centers of top/bottom members 240, 250, the front door panel 110 is rotatably coupled to the parallel top/bottom members 240, 250 by top/bottom center rods 260/270. As shown in FIG. 2, the top/bottom center rods 260/270 define vertical rotational axis SDV, which the front door panel 110 rotates about. The toilet paper roll rotates around the vertical axis VS of the vertical spindle 140, which is parallel with vertical rotational axis SDV. The top/bottom members 240, 250 each include first and second magnets 280, 290, 300, 310 and the top/bottom of the front door panel 110 each include first and second magnets 320, 330, 340, 350.

In use, the spindle 100 is provided in the space between wall joists and drywalls. In the position shown in FIG. 1, the half circle platform 120, vertical spindle 140, and toilet paper thereon sits recessed into the bathroom wall. The front door panel 110 rotates around the center rods 260, 270, effectively creating a free floating and rotating platform 120. When the user pushes on one side of the front door panel 110, as shown in FIGS. 1-3, the panel 110 rotates horizontally 180 degrees to reveal a roll of toilet paper on the vertical spindle 140. While the platform 120 can freely rotate 360 degrees, magnets 280, 290, 300, 310, 320, 330, 340, 350 in the top/bottom members 240, 250 and the top/bottom of the front door panel 110 stop the rotating door panel at 180 degrees. This always keeps the front door panel 110 fully open or fully closed with the panel 110 parallel with the top/bottom members 240, 250. When not in use, the front door panel 110 can be turned 180 degrees to have the toilet paper face the wall. Also, while closed, the front door panel 110 and outer framing will be less than 2 inches off the wall 80 (about one third of a regular toilet paper spindle). The frame member 200 will overlap the drywall by 1⅞ inches and utilize flanges to clamp the frame member 200 to the drywall. The door panel 110 and frame member 200 are made of one or more of, but not limited to, different wood tones, stainless steel, and chrome for greater aesthetic appeal.

Figure 9:
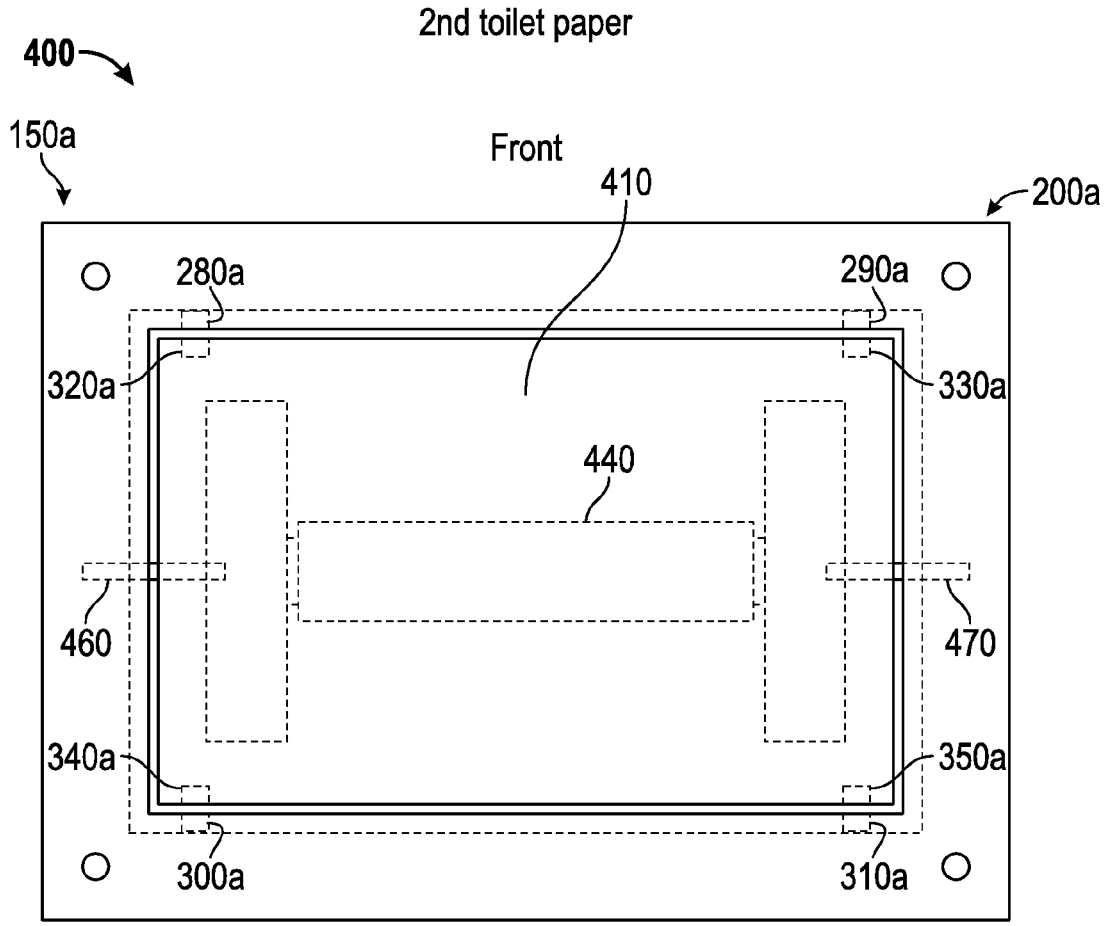
FIG. 9 is a front elevational view of another embodiment of a concealable toilet paper spindle shown in a closed condition.
Figure 10:
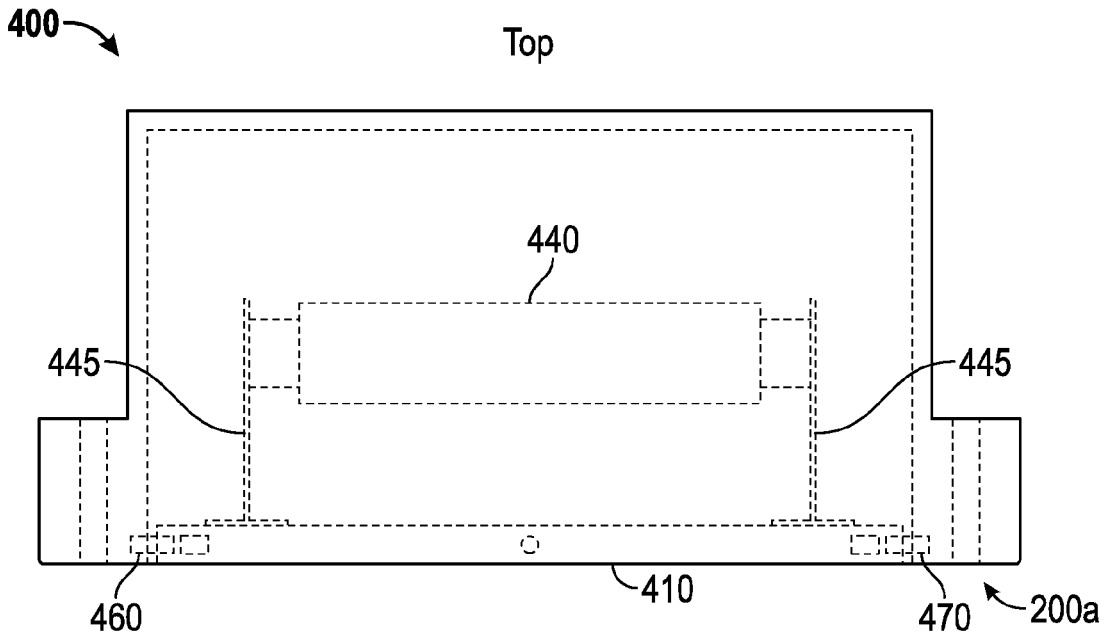
FIG. 10 is a top plan view of the concealable toilet paper spindle of FIG. 9 shown in a closed condition.
Figure 11:
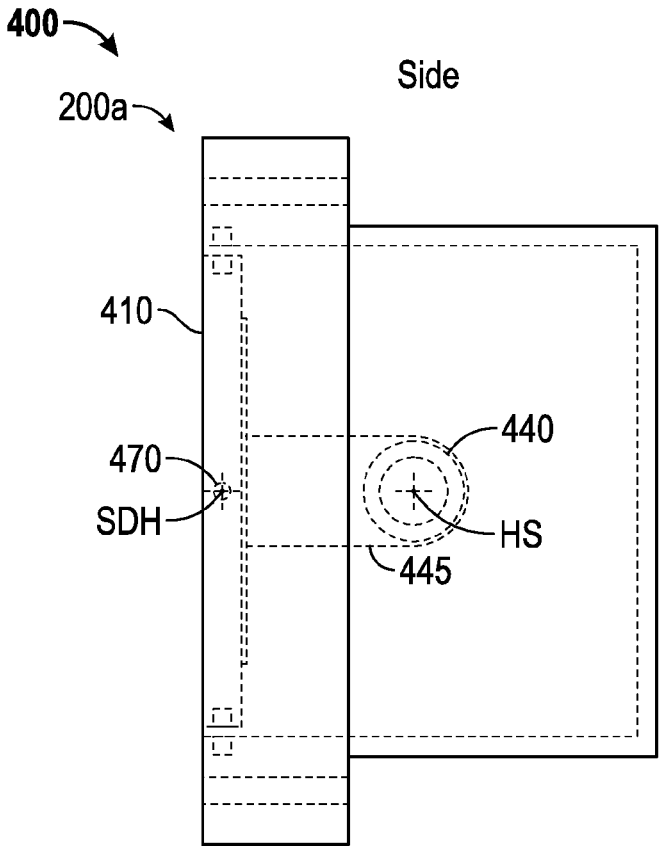
FIG. 11 is a side elevational view of the concealable toilet paper spindle of FIG. 9 shown in a closed condition.

FIGS. 9-11 illustrate another embodiment of a concealable toilet paper spindle 400 shown in a closed condition. The concealable horizontal toilet paper spindle 400 is similar to the concealable toilet paper spindle 100, except instead of the spindle door rotating around a vertical axis, spindle door 410 rotates about a horizontal axis SDH. Also, the concealable toilet paper spindle 400 includes a horizontal spindle 440 with a horizontal spindle axis HS parallel with the horizontal axis SDH of the spindle door 410. Like elements to those described and shown above with respect to FIGS. 1-8 are shown with similar reference numbers, but with an "a" suffix and will not be described below.

This concealable horizontal toilet paper spindle 400 is designed to provide both practical as well as aesthetic value. By utilizing the space between wall joists and drywalls, the horizontal spindle 440 hangs behind the vertically rotating door panel 410. The front door panel 410 and spindle support arms 445 are attached to framed housing 150*a* that sits recessed into the bathroom wall. The door panel 410 revolves around center rods 460, 470 that penetrate the side framing of rectangular frame member 200*a* as well as both sides of the door panel 410. When the user pushes on either the top or bottom of the door panel 410, the door will revolve vertically 180 degrees to reveal a roll of toilet paper on horizontal spindle 440, which is attached to a backside of the door panel 410 via the spindle support arms 445. While the door panel 410 can freely rotate 360 degrees, magnets 280*a*, 290*a*, 300*a*, 310*a* in the upper and lower framing of rectangular frame member 200*a* will be utilized to stop the rotating door panel 410 at 180 degrees. This always keeps the front door panel 410 fully open or fully closed with the door panel 410 parallel with the upper and lower framing of the of rectangular frame member 200*a*. When not in use, the door panel 410 can be turned 180 degrees to have the toilet paper face into the wall. Also, while closed, the front door panel 410 and rectangular frame member 200*a* will be a little more than 2 inches off the wall 80 (less than half the distance of a regular toilet paper spindle). The rectangular frame member 200*a* will overlap the drywall by 2⅜ inches and utilize flanges to clamp the rectangular frame member 200*a* to the drywall. The door panel 410 and rectangular frame member 200*a* are made of one or more of, but not limited to, different wood tones, stainless steel, and chrome for greater aesthetic appeal.

Figure 12:
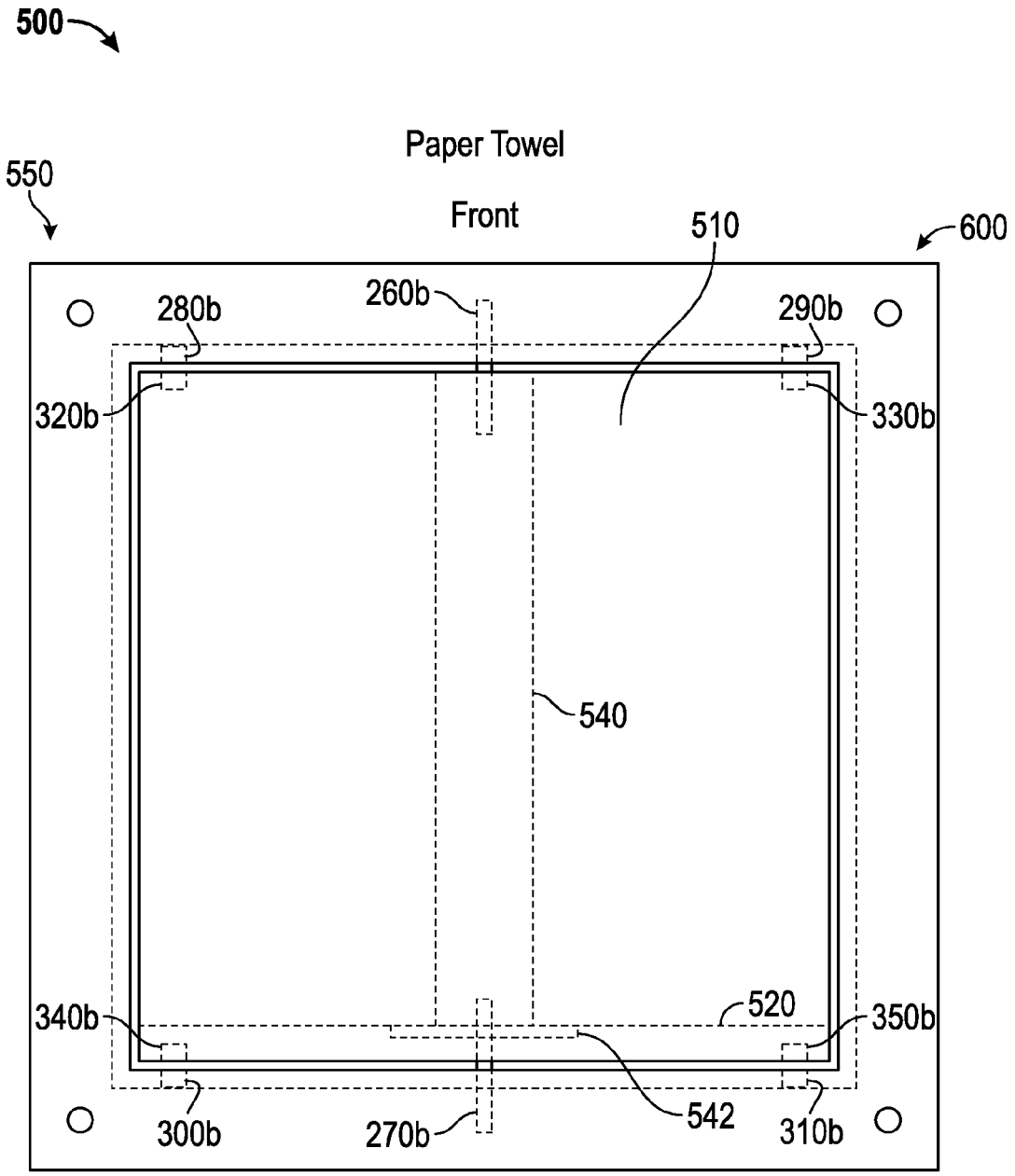
FIG. 12 is a front elevational view of another embodiment of a concealable toilet paper spindle shown in a closed condition.
Figure 13:
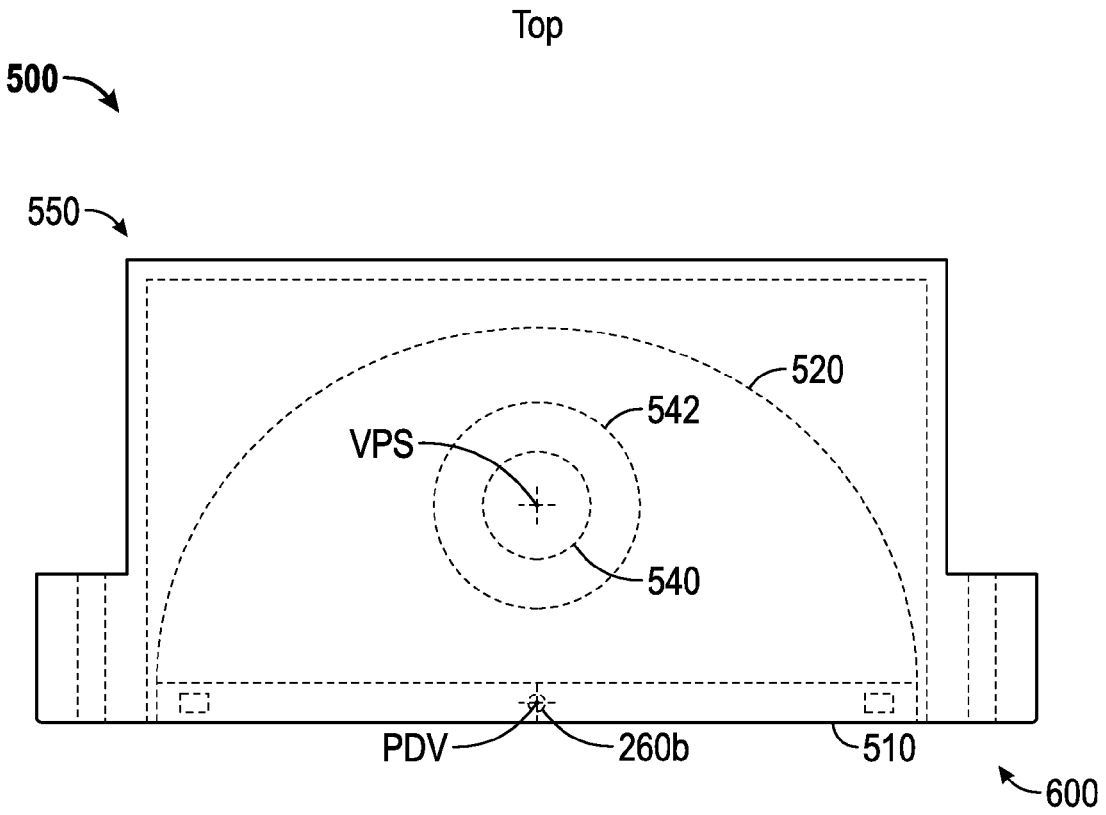
FIG. 13 is a top plan view of the concealable toilet paper spindle of FIG. 12 shown in a closed condition.
Figure 14:
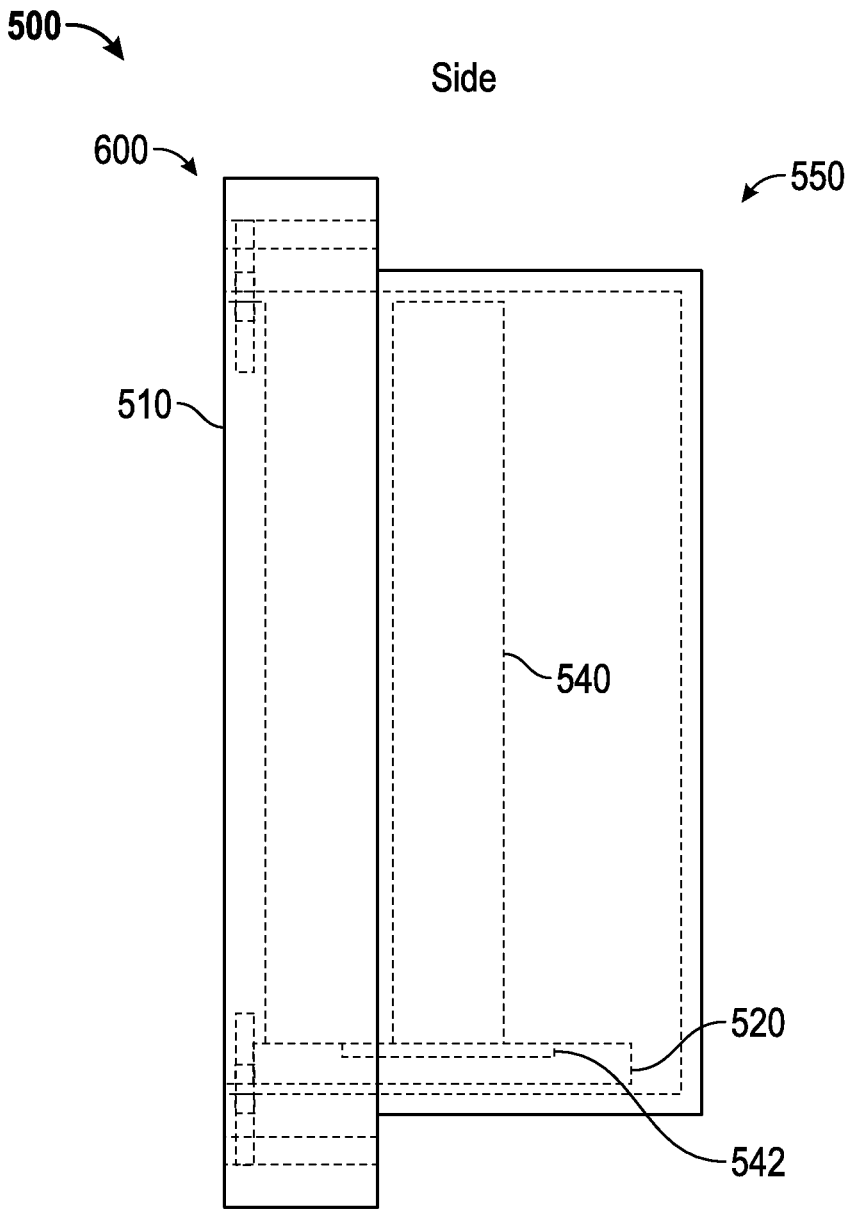
FIG. 14 is a side elevational view of the concealable toilet paper spindle of FIG. 12 shown in a closed condition.

FIGS. 12-14 illustrate an embodiment of a paper towel concealable spindle 500 shown in a closed condition. The paper towel concealable spindle 500 is generally similar to the concealable toilet paper spindle 100, except that the paper towel concealable spindle 500 and framed housing 550 are more vertically elongated to accommodate the more vertically elongated paper towel. Thus, from a front view, as shown in FIG. 12, framed housing 550 and frame member 600 have a substantially square configuration or a vertically elongated rectangular configuration instead of horizontally elongated rectangular configuration as shown with the concealable toilet paper spindle 100 of FIGS. 1-8. Like elements to those described and shown above with respect to FIGS. 1-8 are shown with similar reference numbers, but with a "b" suffix and will not be described below.

The paper towel concealable spindle 500 is designed to provide both practical as well as aesthetic value. By utilizing the space between wall joists and drywalls, vertical spindle 540 sits on a half circle platform 520 behind a horizontally rotating door panel 510. The front panel 510 and platform 520 will be attached to the framed housing 550 that sits recessed into the bathroom wall. The door panel 510 rotates around center rods 260*b*, 270*b* that penetrate the upper and lower framing of frame member 600 as well as the top and bottom of the door panel 510, effectively creating a free floating and rotating platform 520. Similar to the concealable spindle 100, the vertical spindle 540 includes a vertical spindle axis VPS that is parallel with the vertical rotational axis PDV defined by the center rods 260*b*, 270*b*. When the user pushes on one side of the door panel 510, the door panel 510 will rotate horizontally 180 degrees to reveal a paper towel roll on vertical spindle 540. The spindle 540 will sit atop a 3 3/16 inch diameter removable disc 542 that sits 3/16 into a corresponding recess in the center of the rotating platform 520. The disc 542 remain unattached/removable 80 (with the spindle 540) relative to the platform 520, allowing for an easier change of paper towels under tight counters. While the platform 520 can freely rotate 360 degrees, magnets 280*b*, 290*b*, 300*b*, 310*b* in the upper and lower framing of the frame member 600 are utilized to stop the rotating door panel 510 at 180 degrees. This will always keep the front door panel 510 fully open or fully closed with the front door panel 510 parallel with the upper and lower outer framing of the frame member 600. When not in use, the door panel 510 can be turned 180 degrees to have the paper towel face into the wall. The frame member 600 will overlap the drywall by 2 7/8 inches and utilize flanges to clamp the frame member 600 to the drywall. This will allow for more counter workspace, especially in smaller kitchens. The door panel 510 and frame member 600 are made of one or more of, but not limited to, different wood tones, stainless steel, and chrome for greater aesthetic appeal compared to a paper towel roll sitting out on the open counter or hanging from the bottom of the kitchen cabinets.

Figure 15:
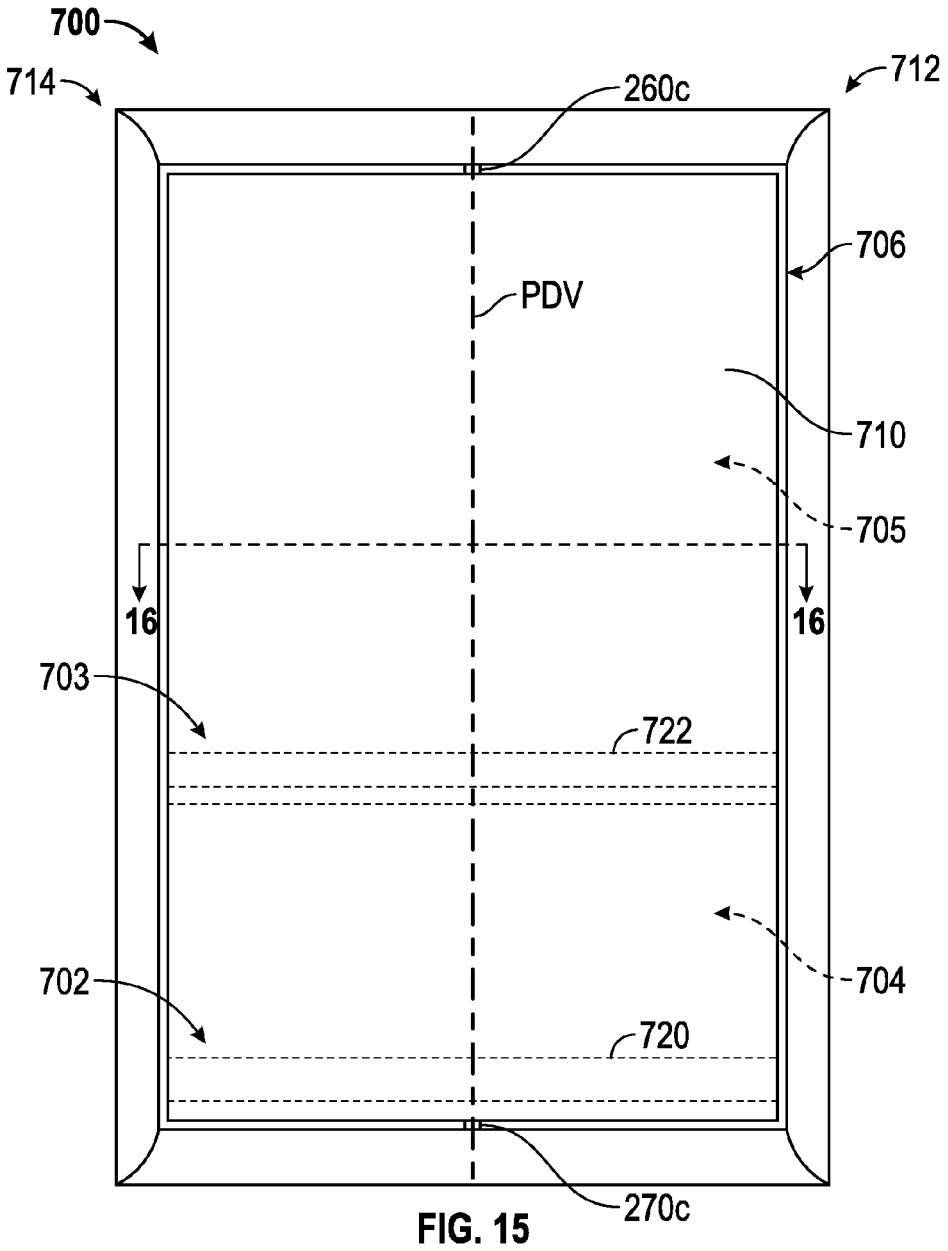
FIG. 15 is front elevational view of an embodiment of a concealable medicine shower caddy in a closed condition.
Figure 16:
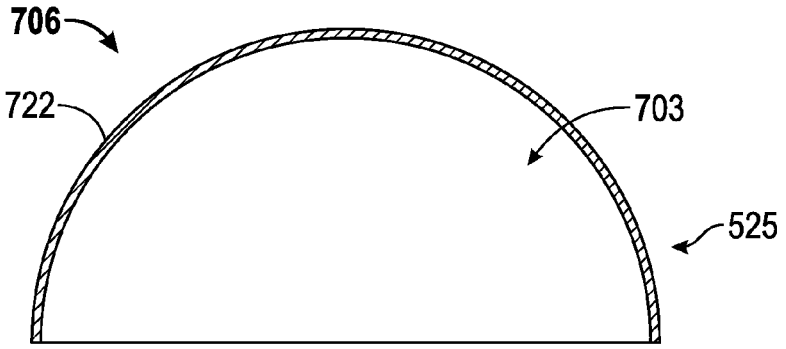
FIG. 16 is cross-sectional view taken along lines 16-16 of FIG. 15 of a half circle platform of the concealable shower caddy.

With reference to FIGS. 15 and 16, an embodiment of a concealable shower caddy 700 will be described. The concealable shower caddy 700 is shown in a closed condition. The concealable shower caddy 700 is generally similar to the paper towel concealable spindle 500, except that the concealable shower caddy 700 is more vertically elongated, does not include spindle 540/disc 542, and includes at least two vertically stacked shelves 702, 703 and sections 704, 705. Like elements to those described and shown above with respect to FIGS. 1-8 are shown with similar reference numbers, but with a "c" suffix and will not be described below.

The concealable shower caddy 700 is designed to provide both practical as well as aesthetic value. The concealable shower caddy 700 includes concealable rotating member 706 having a door/front panel 710 that rotates about center rods 260*c*, 270*c*, which define vertical rotational axis PDV, and penetrate the upper and lower framing of frame member 712 of framed housing 714 as well as the top and bottom of the door panel 510. Framed housing 714 sits recessed into the wall in the space between wall joists and drywall 80(s). The concealable rotating member 706 includes the at least two vertically stacked shelves 702, 703 and sections 704, 705. Lower shelf 702 is a half or semicircular platform with a small perimeter retaining wall 720. Upper shelf 703 is also a half or semicircular platform with a small perimeter retaining wall 722. Each shelf 702, 703 and section 704, 705 can be used to store different shower products 80 (e.g., shampoo, conditioner, shaving razor, etc.).

When the user pushes on one side of the door panel 710, the concealable rotating member 706 including door panel 710 will rotate horizontally 180 degrees to reveal the shower-related products. While the concealable rotating member 706 can freely rotate 360 degrees, a stopping mechanism around/attached to the pivoting rods will be utilized to stop the rotating door panel 710 at 180 degrees. This allows the front door panel 710 to be fully open or fully closed with the front door panel 710 parallel with the upper and lower outer framing of the frame member 712. When not in use, the door panel 710 can be turned 180 degrees to have the shelves 702, 703 face into the wall.

In the embodiments shown and described with respect to FIGS. 1-14, the stopping mechanism may replace the magnets.

The door panel 710 and frame member 712 are made of one or more of, but not limited to, plastic, different wood tones, stainless steel, chrome and other various finishes for greater aesthetic appeal.

Although described as a concealable shower caddy 700, in an alternative embodiment, the structure shown and described with respect to FIGS. 15 and 16 is a concealable medicine cabinet that is installed in a bathroom wall 80 (e.g., over the sink) to hold toiletries and other medicine cabinet items.

In a further embodiment, the structure shown and described with respect to FIGS. 15 and 16 does not include upper shelf 703 and is a concealable toilet bowl brush holder that is installed in a bathroom wall to hold a toilet bowl brush on the shelf 702.

In a still further embodiment, the structure shown and described with respect to FIGS. 15 and 16 does not include upper shelf 703 and is a concealable toilet bowl plunger that is installed in a bathroom wall to hold a toilet bowl plunger on the shelf 702.

Figure 17:
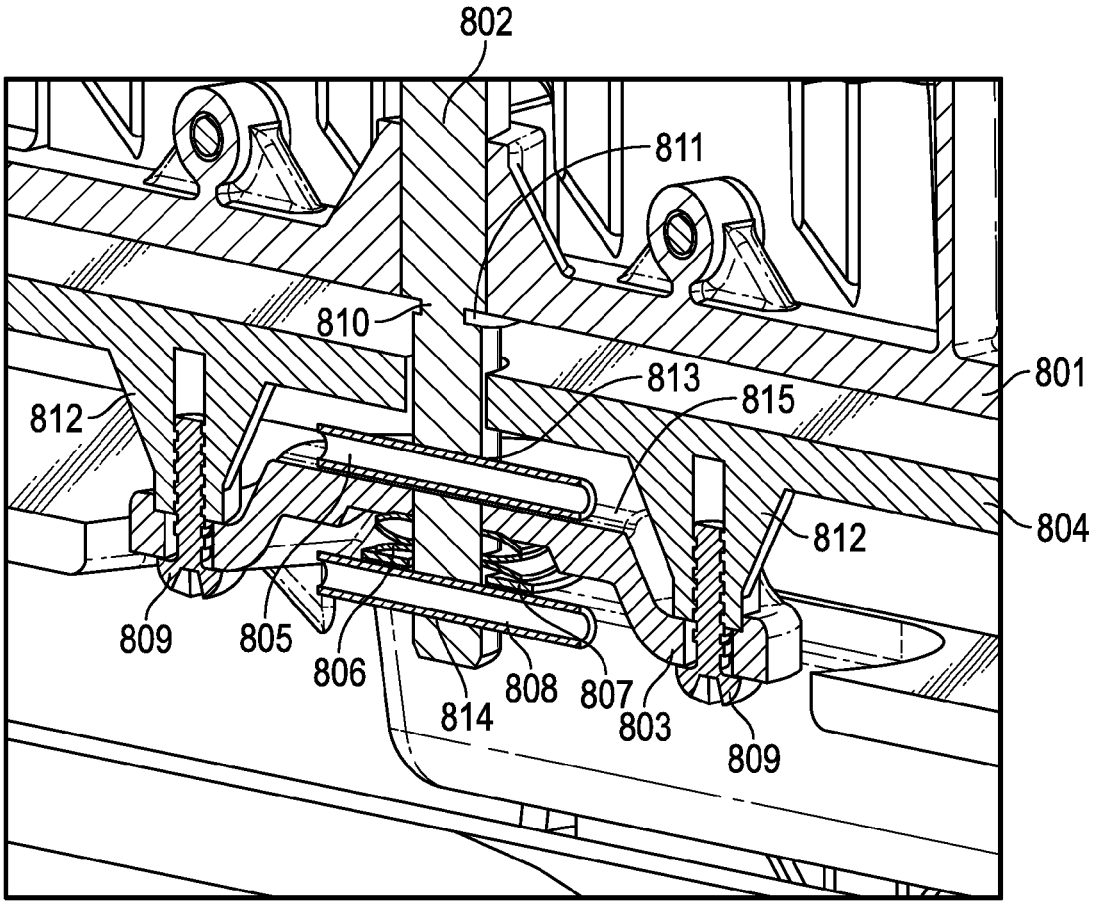
FIG. 17 is cross-sectional view of an embodiment of a door rotation mechanism.

With reference to FIG. 17, an embodiment of door rotation mechanism 800 used with the spindles, caddies, and holders shown and described above with respect to FIGS. 1-16 will be described. The door rotation mechanism 800 not only allows for rotation in door 801, but also provides stops for both an open door position and a closed door position.

In the door rotation mechanism 800, the door 801 is rigidly connected to an axle shaft 802 via a press fit. The axle shaft 802 is pivotally connected to a detent 803. The detent 803 is rigidly attached to a housing member or enclosure 804 using screws 809 that thread into bosses 812 provided in the enclosure 804. The axle shaft 802 has an annular groove 810 with a retaining ring 811 installed that the door 801 rests against. An inner roll pin 805 is press fit into an inner cross-drilled hole 813 in and perpendicular to the axle shaft 802.

When the door 801 is in the open or closed position, the inner role pin 805 rests inside a v-shaped groove 815 on an inner surface of the detent 803. A spring 806 is axially located on an outer portion of the axle shaft 802 and contacts an outer surface of the detent 803. A washer 807 is axially located on the outer portion of the axle shaft 802 and contacts an outer end of the spring 806. An outer roll pin 808 is press fit into an outer cross-drilled hole 814 in and perpendicular to the axle shaft 802.

The installed inner roll pin 805 and installed outer roll pin 808 are sufficiently close together to compress the spring 806, developing a contact force between the inner roll pin 805 and detent 803. This contact force pulls the upper roll pin 805 into the bottom of the groove 815 in the detent 803 and provides a centering force for the door 801 in the enclosure 804.

When the door 801 is pivoted within the enclosure 804, the axle shaft 802 is forced to rotate together with the door 801. When the axle 802 is rotated, the inner roll pin 805 is forced in and out of the groove 815 in the inner surface of the detent 803 and the outer roll pin 808 further compresses the spring 806. The axle 802 and door 801 are pushed inward slightly until the inner roll pin 805 has completely moved out of the groove 815. Once the inner roll pin 805 has completely moved out of the groove, the force required to continue rotating the door is reduced because the spring 806 is no longer being further compressed.

When the door 801 has been pivoted close to 180 degrees, the inner roll pin 805 starts to re-engage the groove 815 in the inner surface of the detent 803. The spring force draws the inner roll pin 805 into the groove 815. The axle 802 and door 801 drop slightly until the inner roll pin 805 comes to rest fully within the groove 815.

Although the door rotation mechanism 800 of FIG. 17 shows the door 801 rotating with the axle 802 about a vertical rotational door axis, in an alternative embodiment, FIG. 17 is rotated 90 degrees clockwise or counterclockwise so that the door 801 rotates with the axle 802 about a horizontal rotational door axis. Such an embodiment is used, for example, in the embodiment of the concealable horizontal toilet paper spindle 400 of FIGS. 9-11.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items e present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A concealable waste paper holder for dispensing waste paper from a waste paper roll, comprising:

a frame mountable to a wall;

a door rotatably mounted to the frame about a door rotational axis between an open position where the waste paper roll is accessible and a closed position where the door is substantially parallel with the wall and conceals the waste paper roll;

a spindle for rotationally receiving the waste paper roll about a spindle axis and dispensing the waste paper from the waste paper roll there when the door is the open position, the spindle carried by the door for rotation with the door, wherein the spindle axis and the door rotational axis are parallel, wherein the concealable waste paper holder includes a door rotation mechanism including an axle that rotates with the door, a roll pin perpendicularly disposed relative to the axle and rotating with the axle, and a roll pin engagement surface that the roll pin slidably engages, the roll pin engagement surface including a groove that the roll pin engages, forming a stop for rotation of the door in the closed position and the open position.

2. The concealable waste paper holder of claim 1, wherein the concealable waste paper holder is a concealable toilet paper holder for dispensing toilet paper from a toilet paper roll.

3. The concealable waste paper holder of claim 1, wherein the concealable waste paper holder is a concealable paper towel holder for dispensing paper towel from a paper towel roll.

4. The concealable waste paper holder of claim 1, further including a horizontally disposed platform and the spindle is a vertically disposed spindle that is coupled only with the horizontally disposed platform and extends vertically upwardly from the horizontally disposed platform.

5. The concealable waste paper holder of claim 4, wherein the platform includes a substantial center of the platform that the spindle extends vertically upwardly from.

6. The concealable waste paper holder of claim 1, wherein the door rotates about the door rotational axis when a user pushes in on the door at a lateral location offset from the door rotational axis.

7. The concealable waste paper holder of claim 1, wherein the door rotation mechanism includes a spring that urges at least one of the roll pin and the engagement surface together.

8. The concealable waste paper holder of claim 1, wherein the axle of the door rotation mechanism is vertical.

9. The concealable waste paper holder of claim 1, wherein the axle of the door rotation mechanism is horizontal.

10. A concealable holder for selectively concealing and accessing one or more objects, comprising:

a frame mountable to a wall;

a door rotatably mounted to the frame about a door rotational axis between an open position where the one or more objects are accessible and a closed position where the door is substantially parallel with the wall and conceals the one or more objects;

a holder including one or more sections for holding the one or more objects;

a spindle carried by the door for rotation with the door, wherein the concealable holder includes a door rotation mechanism including an axle that rotates with the door, a roll in perpendicularly disposed relative to the axle and rotating with the axle, and a roll pin engagement surface that the roll pin slidably engages, the roll pin engagement surface including a groove that the roll pin engages, forming a stop for rotation of the door in the closed position and the open position.

11. The concealable holder of claim 10, wherein the door rotational axis is vertical.

12. The concealable holder of claim 10, further including a horizontally disposed platform and the spindle is a vertically disposed spindle that is coupled only with the horizontally disposed platform and extends vertically upwardly from the horizontally disposed platform, and the platform includes a substantial center of the platform that the spindle extends vertically upwardly from.

13. The concealable holder of claim 10, wherein the door rotates about the door rotational axis when a user pushes in on the door at a lateral location offset from the door rotational axis.

14. The concealable holder of claim 10, wherein the door rotation mechanism includes a spring that urges at least one of the roll pin and the engagement surface together.

* * * * *